US008789397B2

(12) United States Patent
Leibman et al.

(10) Patent No.: US 8,789,397 B2
(45) Date of Patent: Jul. 29, 2014

(54) ADDITIVE STORAGE TANK FOR A WASHING MACHINE

(75) Inventors: Alexander Boris Leibman, Prospect, KY (US); Jerrod Aaron Kappler, Louisville, KY (US); Alaknanda Acharya, Louisville, KY (US)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 13/095,999

(22) Filed: Apr. 28, 2011

(65) Prior Publication Data

US 2012/0272692 A1 Nov. 1, 2012

(51) Int. Cl.
*D06F 35/00* (2006.01)

(52) U.S. Cl.
USPC ..... 68/17 R; 68/12.18

(58) Field of Classification Search
USPC ..... 68/17 R, 12.18
See application file for complete search history.

(56) References Cited

U.S. PATENT DOCUMENTS

| | | | | |
|---|---|---|---|---|
| 3,990,272 | A | 11/1976 | Gakhar | |
| 4,986,093 | A * | 1/1991 | Pastryk et al. | 68/13 R |
| 2009/0095750 | A1 | 4/2009 | Vitan et al. | |
| 2010/0000023 | A1 | 1/2010 | McAllister et al. | |

* cited by examiner

*Primary Examiner* — Michael Barr
*Assistant Examiner* — Spencer Bell
(74) *Attorney, Agent, or Firm* — Dority & Manning, P.A.

(57) ABSTRACT

A washing appliance, such as a consumer washing machine, has a casing and a tub disposed within the casing. The tub includes a basket configured for receipt of articles to be washed. A vertically oriented additive storage tank is disposed between the casing and the tub. The storage tank includes a first vertical storage component disposed at a first location between the casing and tub, and a second vertical storage component disposed at a second location between the casing and the tub spaced from the first location. The storage tank further includes a bottom transversely extending storage component that extends between the first and second vertical storage components below the tub.

13 Claims, 5 Drawing Sheets

FIG. —1—

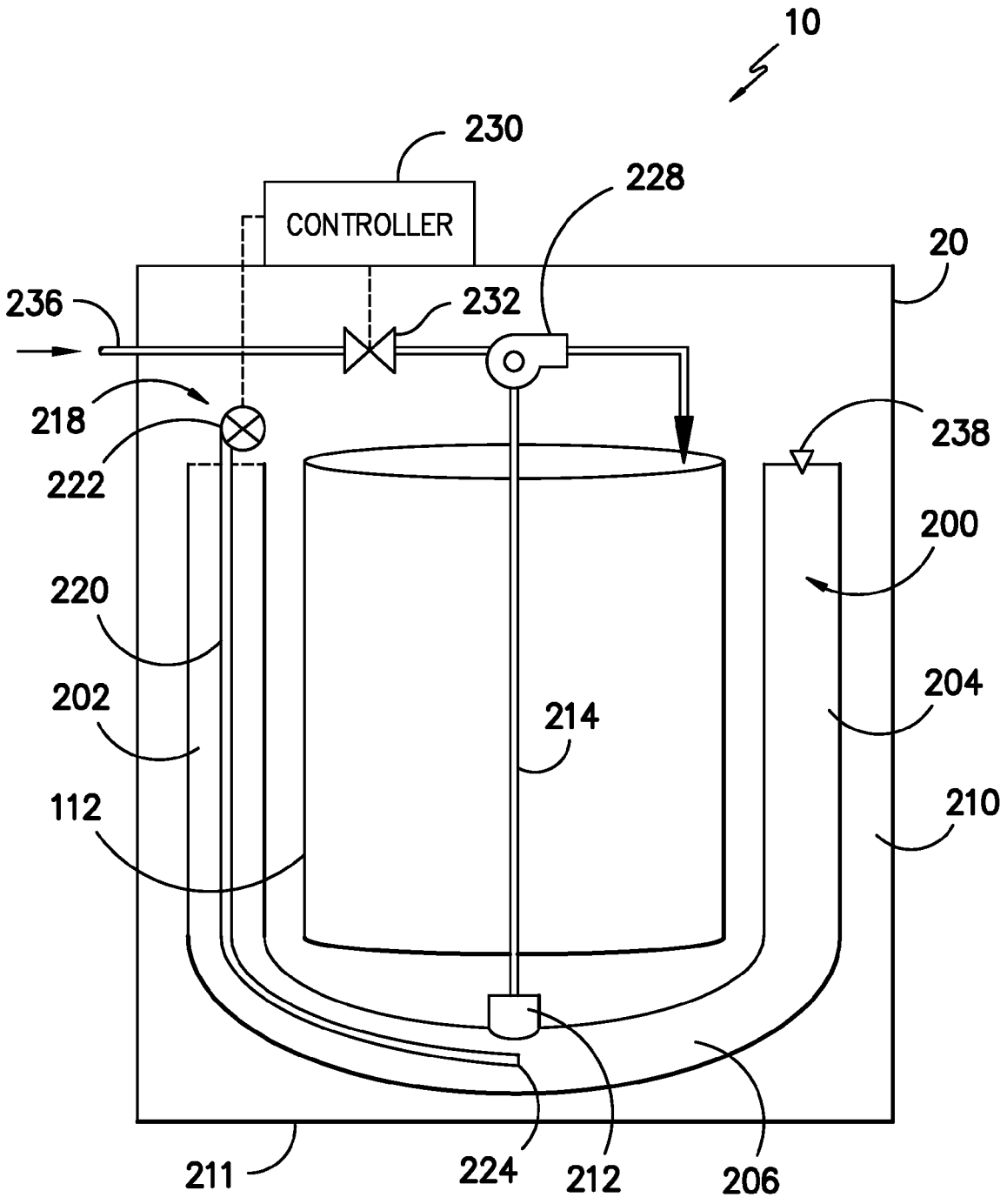
FIG. —3—

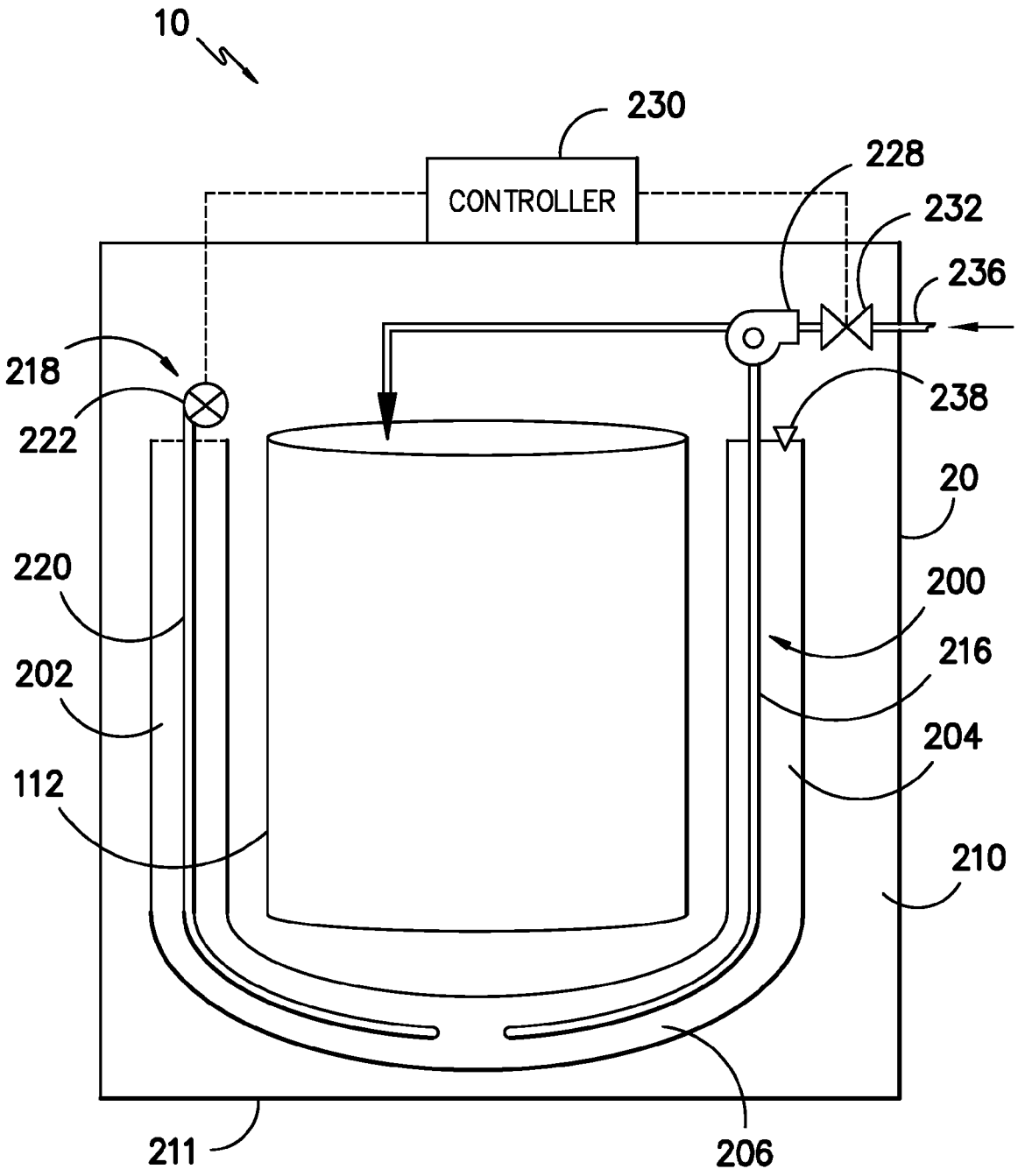
FIG. —4—

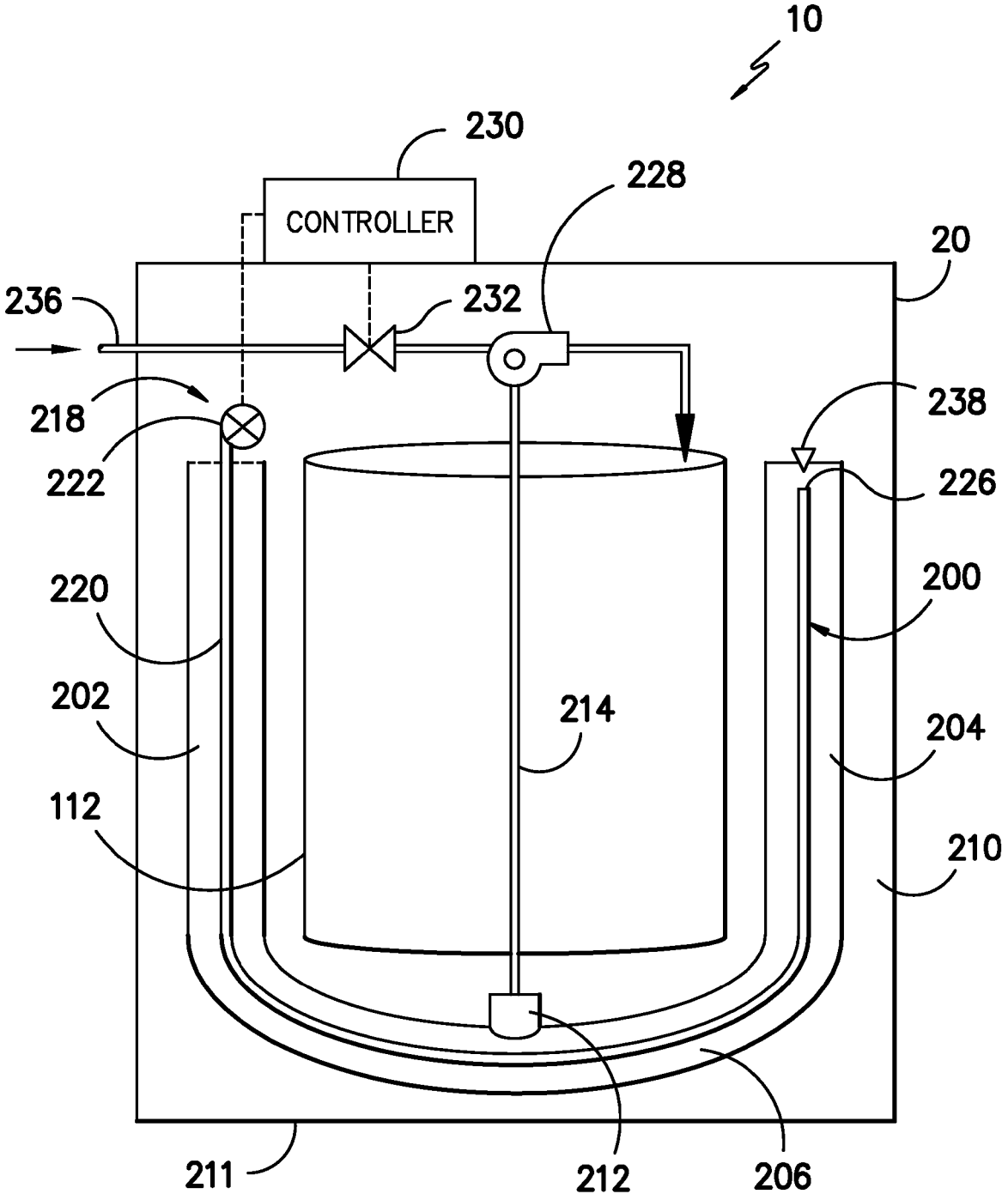
FIG. –5–

ADDITIVE STORAGE TANK FOR A WASHING MACHINE

FIELD OF THE INVENTION

The present subject matter relates generally to appliances such as washing machines, and more particularly to an additive dispensing system in a washing machine.

BACKGROUND OF THE INVENTION

Conventional residential washing machines typically include an internal additive storage system that stores a bulk quantity of an additive (such as detergent, fabric softener, and so forth) and dispenses a metered quantity of the additive at a defined point in the wash cycle. These systems use an internal storage tank that must be accommodated in the tight space between the drum/tub and machine casing. Thus, the capacity of the storage tank is limited and requires frequent refilling by the consumer.

Also, with the conventional internal additive storage tanks, reliable liquid level sensing within the tank can be problematic due to the contoured and non-uniform shape of the tank. If the tanks are not readily visible to the consumer, relatively expensive sensing devices may be required to provide an accurate indication of the amount of additive left in the tank.

Accordingly, it would be desirable to provide a washing machine with an additive storage tank having increased capacity and a relatively simple but reliable liquid level sensor.

BRIEF DESCRIPTION OF THE INVENTION

Aspects and advantages of the invention will be set forth in part in the following description, or may be obvious from the description, or may be learned through practice of the invention.

In a particular embodiment, a washing appliance, such a consumer washing machine, includes a casing and a tub disposed within the casing. The tub includes a basket configured for receipt of articles to be washed. A vertically oriented liquid additive storage tank is disposed between the casing and the tub. The storage tank has a first vertical storage component disposed at a first location between the casing and tub, and a second vertical storage component disposed at a second location between the casing and the tub spaced from the first location. The storage tank further includes a bottom transversely extending storage component that extends between the first and second vertical storage components below the tub.

Typically, the casing is a box-shaped component and the tub is a cylindrical-shaped component. In a particular embodiment, the first vertical storage component is disposed in a first corner location of the casing and the second vertical storage component is disposed in a second corner location. The bottom storage component extends along a side wall of the casing between the first and second corner locations.

The storage tank may be variously configured. For example, the storage tank may have a generally U-shaped or V-shaped configuration. In one embodiment, the storage tank comprises a tubular U-shaped member, which may be non-rigid and bendable so as to conform into the corner locations within the casing.

The bottom storage component may include a port in communication with any manner of suitable external pump line for drawing additive from the storage tank. In another embodiment, an internal pump line may extend through either of the first or second vertical storage compartments and into the bottom storage compartment for drawing additive from the storage tank.

The washing appliance may, in certain embodiments, include a level sensor configured with the storage tank, with the level sensor having a tube that extends through either of the vertical storage compartments proximate to a low point of the bottom storage compartment or into the opposite storage compartment, and a pressure sensor in communication with an external end of the tube. A varying internal air pressure is generated in the tube as a function of the level of liquid within the storage tank and the pressure sensor detects the internal air pressure and produces a corresponding liquid level indication. In one embodiment, the tube may be relatively incompressible and have an open end such that liquid additive in the storage tank enters the tube and generates a varying internal air pressure in the tube as a function of the amount of liquid in the storage tank. In another embodiment, the tube has a closed end and is compressible by the liquid additive within said storage tank. This closed end may extend proximate to the low point of the bottom storage compartment, or may extend into (and through) the opposite vertical storage compartment. The internal air pressure within the closed tube varies as a function of the liquid level in the tank storage compartments.

The appliance may include a pump and a controller, with the controller in communication with the pump and pressure sensor. The controller uses the pressure signals from the pressure sensor for controlling the pump to deliver a metered amount of the liquid additive from the storage tank.

In other aspects, the invention encompasses a washing appliance having a casing, and a tub disposed within the casing with a basket configured for receipt of articles to be washed. A vertically oriented additive storage tank is disposed between the casing and the tub. A level sensor is configured with the storage tank and includes a tube that extends into the storage tank proximate to a low point of the storage tank. A pressure sensor is in communication with an external end of the tube. A varying internal air pressure is generated in the tube as a function of the level of liquid within the storage tank. The pressure sensor detects the internal air pressure within the tube and produces a corresponding liquid level indication.

The tube may have an open end that extends proximate to the low point of the storage compartment or, in another embodiment, may have a closed end and be compressible by the liquid additive within the storage tank.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a side diagram view of a washing machine with an embodiment of an additive storage tank;

FIG. 4 is a side diagram view of a washing machine with a different embodiment of an additive storage tank; and FIG. 5 is a side diagram view of a washing machine with yet another embodiment of an additive storage tank.

DETAILED DESCRIPTION OF THE INVENTION

Figure 1:
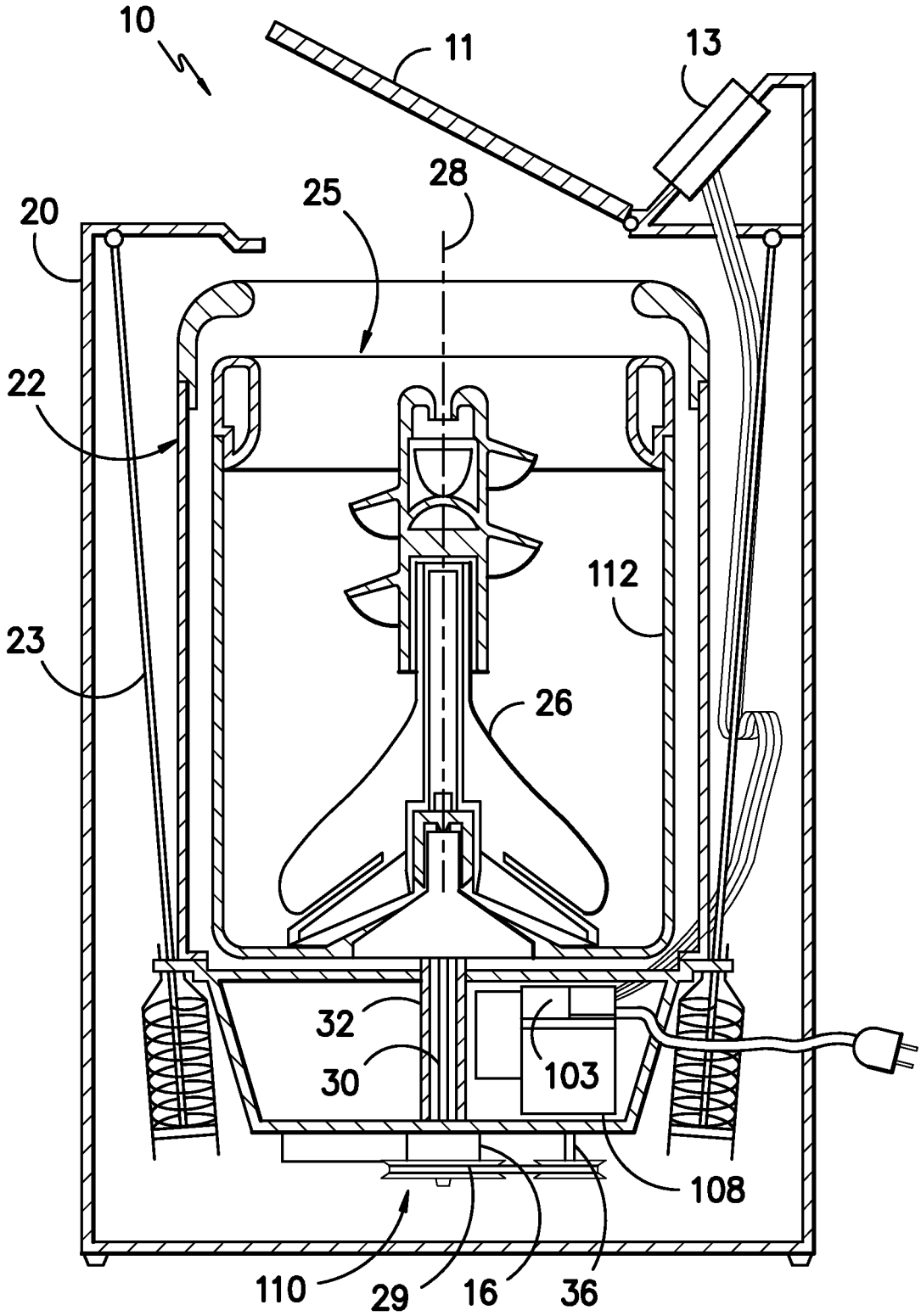
FIG. 1 is a side cut-away view of a conventional washing machine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a conventional washing machine 10 and is provided for illustrative purposes only to place the present invention in its working environment. It should be appreciated that that the invention is not limited to any particular type or style of washing machine 10. In general, such machines 10 are front-loading or top-loading (as in FIG. 1). The machine 10 has an external casing 20 and an internal tub structure 22 suspended with springs 23. A clothes basket 112 and agitator 26 are configured in the drum 22 and revolve bout an axis 28. The basket defines a clothes-receiving opening 25. The basket 112 is driven by a motor 108 via a drive arrangement 110, which may include a pulley mounted to a motor driveshaft 36 connected by a belt 29 to a pulley that is mechanically linked to the basket driveshaft 30 and spin tube 32. The driveshaft 30 is directly coupled to the pulley and belt 29, and drives the agitator 26. The spin tube is directly coupled to the basket 112. A clutch locks elements 30 and 32 together during the spin cycle. The motor is controlled by a control unit 103.

Figure 2:
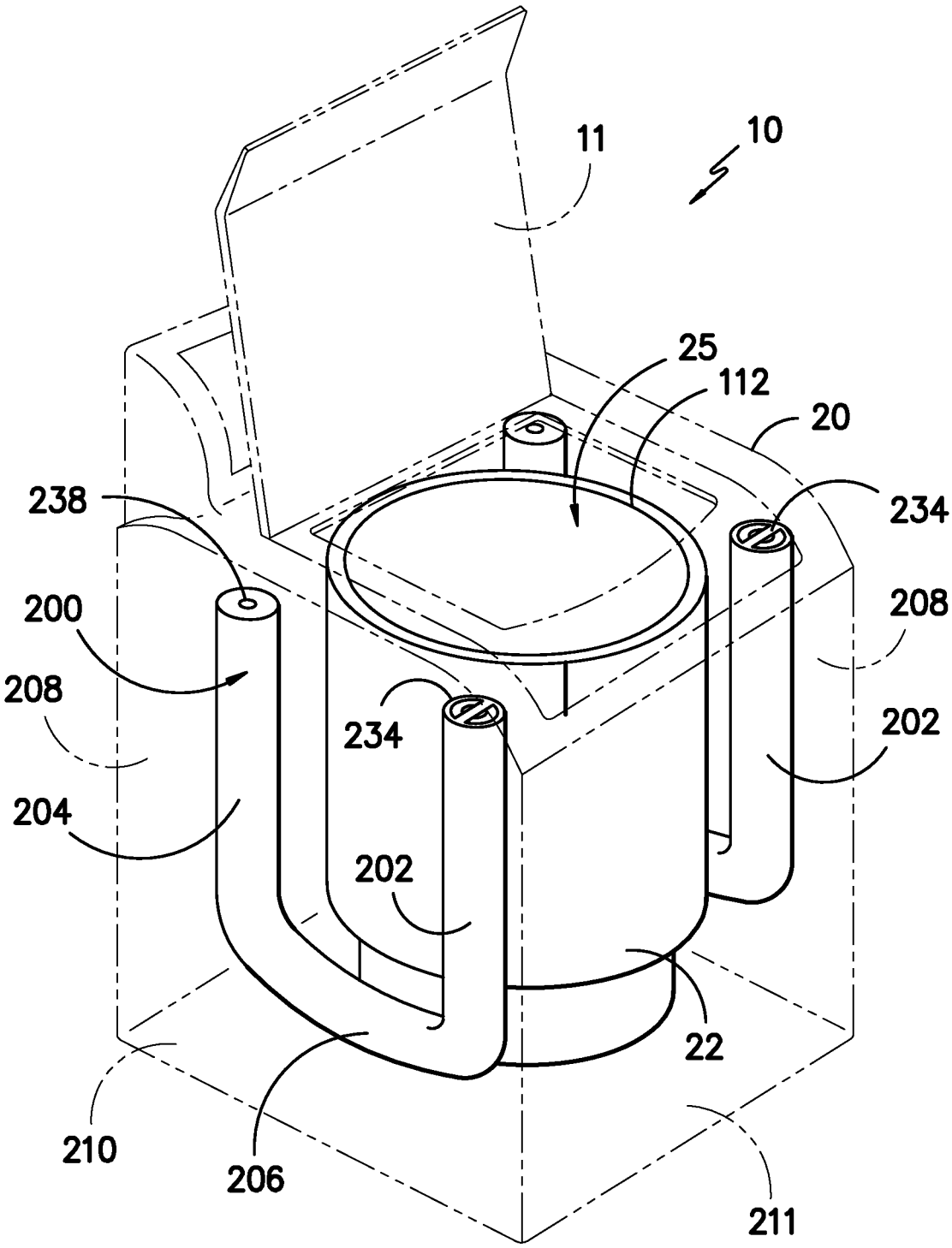
FIG. 2 is a perspective and partial phantom view of a washing machine with an additive storage tank in accordance with aspects of the invention.

Referring to FIG. 2, the washing machine 10 includes casing sidewalls 210 and a casing bottom 211. The casing sidewalls 210 define the corner locations 208 relative to the internal tub 22. A vertically oriented storage tank 200 is disposed between the casing 20 and the tub 22. In the illustrated embodiment, two of the storage tanks 200 are provided and are arranged between the tub 22 and respective side walls 210 of the casing 20. The storage tanks 200 include a first vertical storage compartment 202 arranged in one of the corner locations 208 and a second vertical storage compartment 204 arranged in the adjacent corner location 208. The vertical storage compartments 202, 204 are joined by a bottom, transversally extending storage compartment 206 that extends below the bottom of the tub 22. The vertical storage compartments 202, 204 make use of the space in the corner locations 208 between the drum 22 and the casing 20, and the bottom storage compartment 206 takes advantage of the space below the drum 22.

In the illustrated embodiment, the additive storage tank 200 is depicted as a generally U-shaped tubular member wherein the vertical storage compartments 202, 204 are defined by the opposite upright sections of the tubular member. It should be appreciated that this particular configuration is only one of a number of possible variations. For example, the additive storage tank 200 may have a generally V-shaped configuration wherein the bottom storage compartment 206 is relatively small, and may simply be defined by the intersection point between the upright vertically oriented compartments 202, 204. In another embodiment, the additive storage tank 200 may have a generally squared-off profile wherein the vertical storage compartments 202, 204 are connected by a horizontally extending bottom storage compartment 206.

It should also be appreciated that the vertical storage compartments 202, 204 encompass any generally vertical orientation that extends from a bottom portion of the casing towards the top portion, such as the V-shaped configuration discussed above, and that the compartments need not be at "true" vertical.

The additive storage tanks 200 may be defined by a rigid, semi-rigid, or flexible tubular member, as depicted in the figures, in particular embodiments of the invention. A flexible or bendable member may be preferred in that it can be conformed to the various spaces and components within the interior of the casing 20.

The additive storage tank 200 has an end that is accessible to the user upon opening the machine door 11. This end includes any manner of cap 234 that may be removed for pouring a liquid additive into the tank 200. The end may include a funnel under the cap 234. The opposite end of the storage tank 200 is closed but includes a suitable vent 238 that allows for escape of air within the tank 200 upon filling the tank. The vent 238 may be a relatively simple float-type vent that closes the vent opening at a full condition of the tank 200.

It should be appreciated that the uniquely configured additive storage tanks 200 provide a relatively large volume by utilizing the corner spaces 28 within the casing 20. In addition, the relatively uncomplicated tubular-shape of the storage tanks 200 allows for accurate level sensing of the additive within the tank 200, as discussed in greater detail below.

In the embodiment of FIG. 3, the additive storage tank 200 includes a port 212 in the bottom storage compartment 206. An external pump line 214 is connected to the port and any manner of suitable pump 228 is utilized to draw a metered amount of the liquid additive from the bottom-most location of the tank 200, and to dispense the additive into the clothes basket 112 at the appropriate time during the wash cycle. It should be appreciated that any manner of suitable pump 228 may be utilized for this purpose, including an electric pump, hydraulic pump, and so forth. In the illustrated embodiment, the pump 228 is a venturi that is activated by pressurized water through a water supply line 236. The line 236 is in communication with the external water supply that supplies water to the washing machine 10. Controllable valves 232 are configured in the line 236 on opposite sides of the siphon pump 228. A controller 230 opens the valves 232 upon receipt of a command signal, whereby water flow through the siphon pump 228 generates a low pressure suction through the line 214 and port 212, which draws the liquid additive from the bottom storage compartment 206, through the pump 228, and into the clothes basket 112, as depicted by the arrow in FIG. 3. In this particular embodiment, the amount of additive dispensed is a function of the time the valves 232 are open.

In the embodiment of FIG. 4, the siphon pump 228 utilizes an internal pump line 216 that is fitted into the vertical storage compartment 204 and extends to the bottom-most section of the storage tank 200 within the bottom storage compartment 206. The pump otherwise operates as discussed above with respect to FIG. 3. In the embodiment of FIG. 4, the port 212 for connection with an external pump line is eliminated.

A fluid level sensor configuration 218 is provided with the additive storage tank 200 for control purposes, as well as a level indication for the consumer. Various fluid level sensing systems may be utilized for this purpose, including float-type systems, capacitance levels sensors, RF level sensor, ultrasonic level sensors, and the like. It should be appreciated that the present invention encompasses any suitable level sensing systems that may be configured with the uniquely-shaped vertical additive storage tank 200 to provide accurate level indication, as well as control functionality.

The relatively simply and reliable level sensing system 218 depicted in the figures utilizes a tube 220 that extends through either of the first or second vertical storage compartments 202, 204 with an end that is proximate to a low point of the bottom storage compartment 206, or which extends into the opposite storage compartment. A pressure sensor 222 is configured at the external end of the tube 220. In the embodiment of FIG. 3, the end 224 of the tube 220 within the tank 200 is open. As the tank 200 is filled with a liquid additive, the ambient air within the tube 220 is compressed as the liquid fills the tank 200 and the tube 220 (which is not vented at the external end). This increase in pressure is detected by the pressure sensor 222, which is in communication with the controller 230. The signal from the pressure sensor 222 may be utilized by the controller 230 to generate a fill-level indication for the consumer, which may be displayed on the machine control panel 13 (FIG. 1). The controller 230 may also utilize the pressure signal from the sensor 222 for controlling the valve 232 (or energizing an electric pump) in order to accurately dispense a metered amount of the fluid additive. The change in pressure indicated by the sensor 222 as the liquid level within the tank 200 decreases may be utilized as the control parameter for timed activation of the pump 228.

The level sensor configuration 218 in the embodiment of FIG. 5 utilizes a tube 220 that extends essentially completely through the portions of the additive storage tank 200. The tube 220 has a closed end 226 and a pressure sensor 222 configured at the opposite end. As the tank 200 is filled with a liquid additive, the tube 220 compresses and the ambient air within the tube 220 increases in pressure, which is detected by the pressure sensor 222. The increase in pressure is a function of the level of additive within the tank 200. The pressure indication signals from the sensor 222 may be utilized by the controller 230 in the same manner as discussed above. It should be appreciated that this type of closed-end tube sensor may be used in an embodiment wherein the tube 220 extends to a low point of the bottom storage compartment 206 without extending into the opposite storage compartment.

The liquid level sensing configurations 218 discussed above that rely on an increase in air pressure within a tube inserted into the storage tank 200 are relatively simple, inexpensive, and are not prone to failure of mechanical or powered components. The system also provides an accurate fluid level measurement due largely to the uniform shape of the additive storage tank, particularly if the tank has a relatively constant diameter between the vertical storage compartments 202, 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a casing;

a tub disposed within said casing, the tub including a basket configured for receipt of articles to be washed; and a vertically oriented additive storage tank disposed between said casing and said tub, said storage tank having a volume for receipt of additive that is formed from a first vertical storage component disposed at a first location between said casing and said tub, a second vertical storage component disposed at a second location between said casing and said tub spaced from said first location, and a bottom transversely extending storage component that extends between said first and second vertical storage components below said tub.

2. The appliance as in claim 1, wherein said casing is a box-shaped component and said tub is a cylindrical-shaped component, said first vertical storage component disposed in a first corner location of said casing and said second vertical storage component disposed in a second corner location of said casing, said bottom storage component extending along a side wall of said casing between said first and second corner locations.

3. The appliance as in claim 2, wherein said storage tank has a generally U-shaped or V-shaped configuration.

4. The appliance as in claim 3, wherein said storage tank comprises a tubular member.

5. The appliance as in claim 4, wherein said tubular member is non-rigid and bendable.

6. The appliance as in claim 1, wherein said bottom storage component comprises a port in communication with an external pump line for drawing additive from said storage tank.

7. The appliance as in claim 1, further comprising an internal pump line that extends through either of said first or second vertical storage compartments into said bottom storage compartment for drawing additive from said storage tank.

8. The appliance as in claim 1, further comprising a level sensor configured with said storage tank, said level sensor comprising a tube that extends through either of said first or second vertical storage compartments, and a pressure sensor in communication with an external end of said tube, said tube generating a varying internal air pressure as a function of the level of liquid within said storage tank, said pressure sensor detecting said internal air pressure and producing a corresponding liquid level indication.

9. The appliance as in claim 8, wherein said tube has an open end such that liquid additive in said storage tank enters said tube and varies the internal air pressure in the tube as a function of the amount of liquid in said storage tank.

10. The appliance as in claim 8, wherein said tube has a closed end and is compressible by the liquid additive within said storage tank such that the internal air pressure in the tube varies as a function of the compression force of the liquid additive.

11. The appliance as in claim 10, wherein said closed end of said tube extends proximate to said low point of said bottom storage compartment.

12. The appliance as in claim 10, wherein said closed end of said tube extends through said bottom storage compartment and into the opposite said vertical storage compartment.

13. The appliance as in claim 8, further comprising a pump and a controller, said controller in communication with said pump and said pressure sensor for controlling said pump to deliver a metered amount of the liquid additive from said storage tank to said tub determined by a measured pressure change detected by said pressure sensor.

* * * * *